United States Patent [19]

Rock et al.

[11] 4,455,764

[45] Jun. 26, 1984

[54] MOUNTABLE WARMING CAP FOR A SHOE OR BOOT

[76] Inventors: Harold E. Rock, R.R. 2, Box 452, Berrien Springs, Mich. 49103; Stephen E. Palen, R.R. 1, Box 185, New Buffalo, Mich. 49117

[21] Appl. No.: 386,220

[22] Filed: Jun. 8, 1982

[51] Int. Cl.[3] ..... A43B 7/02; A43B 13/22; A43B 13/14; A43B 23/00

[52] U.S. Cl. ..... 36/136; 36/72 R; 36/77 R; 36/2.6

[58] Field of Search ..... 36/2.6, 72 R, 77 R, 36/77 M, 132, 136

[56] References Cited

U.S. PATENT DOCUMENTS

| | | | |
|---|---|---|---|
| 1,702,583 | 2/1929 | Williams | 36/2.6 |
| 3,175,311 | 3/1965 | MacQuaid | 36/77 R |
| 4,051,612 | 10/1977 | Damron | 36/72 R |
| 4,094,080 | 6/1978 | Sanders | 36/2.6 |

*Primary Examiner*—Patrick D. Lawson
*Attorney, Agent, or Firm*—Harry G. Thibault

[57] ABSTRACT

A warming cap mountable on the toe of a boot. A flexible, heat conductive inner core can be shaped to conform the cap to the shape of the boot and an upper receptacle holds a heat source for generating heat.

6 Claims, 7 Drawing Figures

MOUNTABLE WARMING CAP FOR A SHOE OR BOOT

FIELD OF THE INVENTION

This invention pertains to a warming device mountable on a shoe or boot and readily detachable therefrom.

DESCRIPTION OF THE PRIOR ART

Typically the options for warming the extremities under cold weather conditions are limited for the outdoorsman. Heating devices designed to supplement typical cold weather clothing do not serve all extremities equally well. Although hand-held warmers operate successfully to sufficiently warm the upper extremities, no successful adaptation of such devices has been available for the lower extremities.

The sportsman's only alternative to multiple layers of bulky socks are electrically heated versions thereof which, although they offer an alternative to the bulky foot coverings of the past, also offer no advantages save the reduction of such bulk. Electrically heated socks are of necessity controlled by a simple low-voltage circuit with little or no modulation of heating capabilities provided. Rapid heating of the foot can cause excessive perspiration which dampens the sock to virtually nullify its heating ability.

Thus it would be desirable to provide an external heat source for the outdoorsman's lower extremities, such device generating a gentle penetrating warmth external of one's clothing. Such device should be readily attachable to and detachable from one's boots or shoes. Such devices should not require electric circuitry and thus would not be subject to its shortcomings and disadvantages.

SUMMARY OF THE INVENTION

Accordingly, it is the object of the present invention to provide a simple, external cap suitable for mounting on a shoe or boot, such cap providing means for generating a source of heat, to provide a source of dry penetrating heat to warm the feet of the wearer.

The presenat invention comprises a warming cap constructed to overlie the top of a shoe or boot, more typically a hunting boot. The warming cap is composed of a heat conductive material, in the present instance a copper sheeting. Such sheeting shall be of a thickness which gives some flexibility to the cap so that it may be readily conformed to the shape of the wearer's foot. Further, such boot warming cap shall be modified to include a layer of insulating material on the outer surface of the cap to direct heat generated in the warming cap inwardly toward the boot and its wearer, rather than dissipating such heat into the atmosphere.

Further, such cap shall include a receptacle portion for retaining a heat source of combustible material therein. The receptacle may hold one or more charcoal sticks or similar material such as currently used in known hand warmers. The size and number of charcoal sticks may be modified to the requirements of the wearer. In the present embodiment the receptacle is permanently secured to the upper surface of the boot warming cap as part of the upper structure thereof. The receptacle of the present embodiment includes an upper hinged cover which may be readily opened to insert the combustible material therein, but the receptacle may have any configuration compatible with receiving and retaining the charcoal stocks or similar material. The receptacle must be adequately ventilated to permit the combustible charcoal sticks to continue to burn to maintain heat in the warming cap. Finally the conductive material of the warming cap may require the provision of openings therethrough to assure sufficient and adequate dissipation of heat. The warming cap may, of course, be provided with a detachable and adjustable strap for securing the boot warming cap to the wearer's foot.

Thus the present invention provides a simple and efficient device for heating the feet of the wearer, such device avoiding the shortcomings and disadvantages of the known prior art. The nature of the improvements of the subject device over the prior art may be more clearly understood upon a reading of the detailed description of the subject device as set forth below and an examination of the drawings which accompany the present specification.

DETAILED DESCRIPTION OF THE PREFERRED EMBODIMENT

Figure 1:
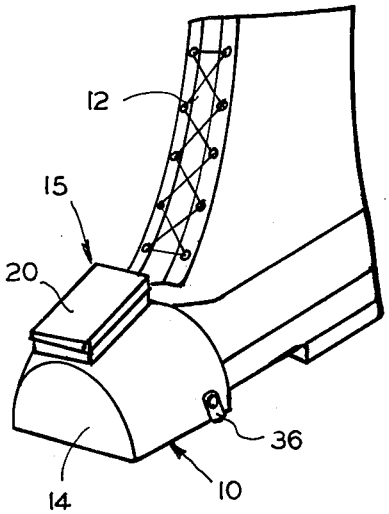
FIG. 1 is a perspective view of the mountable warming cap of the present invention shown mounted on a hunting boot.
Figure 2:
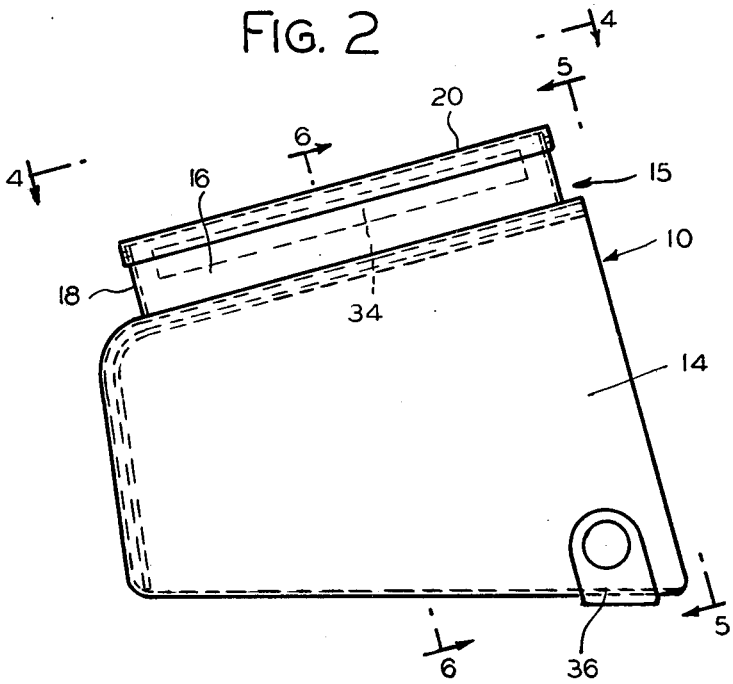
FIG. 2 is a side elevational view of the warming cap of the present invention.
Figure 3:
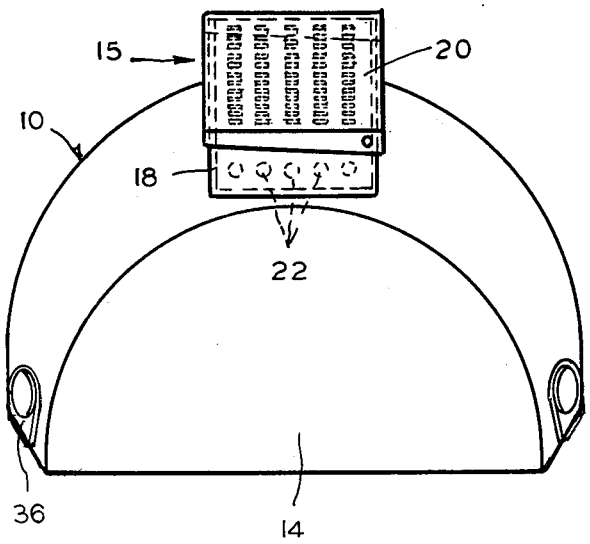
FIG. 3 is a front elevational view of the warming cap shown in FIG. 2.

A mountable warming cap 10 of the present invention may be seen in FIGS. 1 and 2. The cap 10 is mountable on a boot 12 and generally conforms to the shape thereof. The cap 10 comprises a main body portion 14 and an upper receptacle 15. In the preferred embodiment the upper receptacle 15 comprises an elongated rectangular chamber 16 having side walls 17 and end walls 18. A cover 20 is hinged on an end wall 18 as at 21 (FIG. 3). Ventilating openings 22 are provided in end walls 18.

Figure 4:
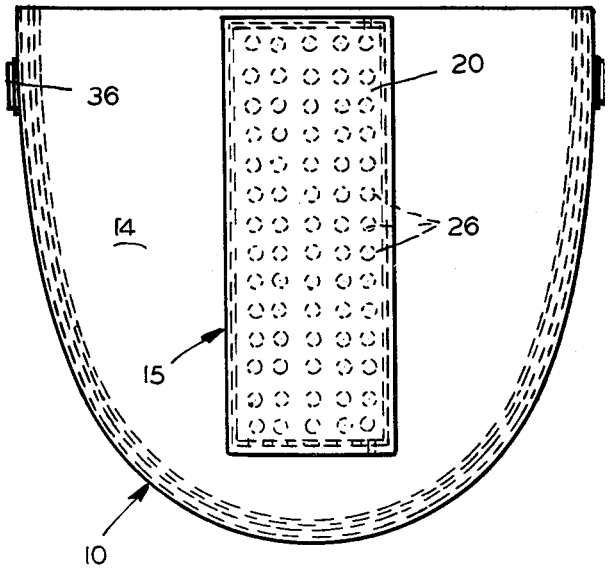
FIG. 4 is a plan view partially in section to show certain details of the cap and generally taken along the line 4—4 of FIG. 2.

As shown in FIG. 4 additional openings 26 provided in the bottom of the receptacle 14 serve to dissipate heat for more effective heat distribution by the warming cap 10.

Figure 5:
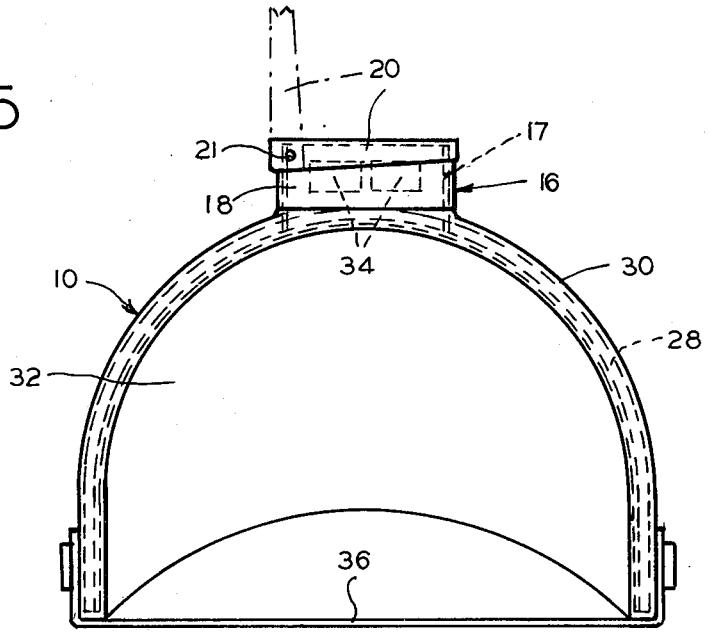
FIG. 5 is an end elevational view taken generally along the line 5—5 of FIG. 2, the warming cap having a portion of its underside uncovered for clarity.
Figure 6:
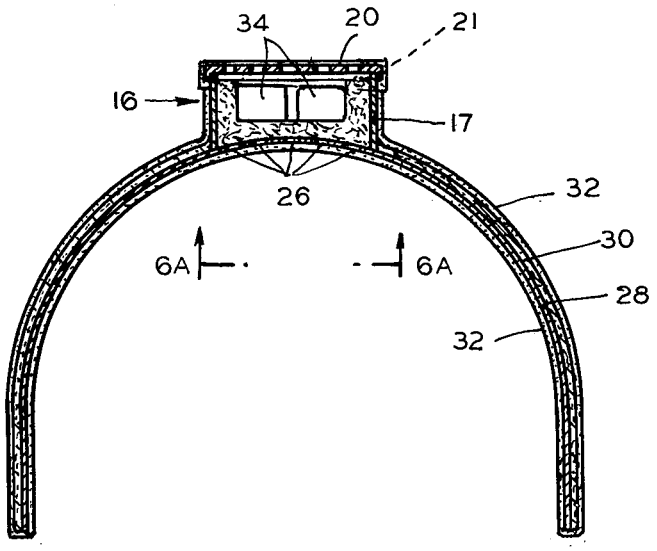
FIG. 6 is a sectional view taken generally along the line 6—6 of FIG. 2.
Figure 6A:
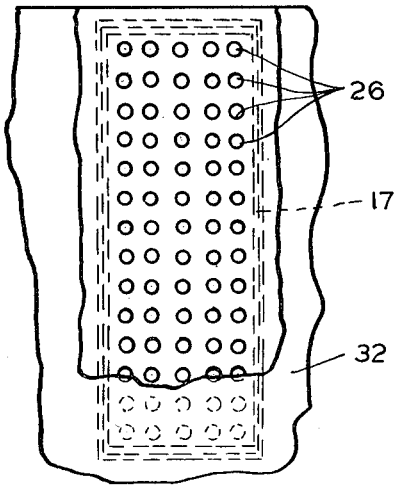
FIG. 6A is a view of the underside of the cap taken generally along the line 6A—6A of FIG. 6, a portion of the cover being removed for clarity.

As shown in FIG. 5, the warming cap 10 comprises an inner core 28 of heat conductive material. In the preferred embodiment, the inner core is composed of copper sheeting. Such sheeting is flexible so that the warming cap 10 may be easily conformed to the boot of the wearer. The inner core 28 of the warming cap 10 is shielded by an outer covering 30 of insulation to prevent heat dissipation to the outside air. A fabric covering 32 both inside and outside covers the warming cap 10 and completes the assembly. If desired, an insulating layer may be provided between the interior of the cap and the fabric covering 32.

In operation the receptacle 14 is loaded with one or more charcoal sticks 34 which are ignited to heat the boot warming cap 10. The receptacle cover 18 is then closed to keep the charcoal sticks 34 in place. If desired, the cap 10 may be provided with a strap 36 to secure it to the boot of the wearer.

Thus the present invention provides a novel device for warming the foot of an outdoorsman, such device providing a means for containing a source of warm dry heat for the foot of the outdoorsman, such device also avoiding the known disadvantages of the prior art. Having thus described a preferred embodiment of the present invention, it should be apparent to those skilled in the art that modifications may be made in the structure illustrated in that equivalent elements may be substituted for the structure which has been disclosed. It is, therefore, intended that all such modifications and substitutions be covered as they are embraced by the appended claims.

We claim:

1. A warming cap mountable on the toe of a shoe or boot, said cap comprising a main body portion having an inner core of flexible, heat conductive material capable of being conformed to the shape of the toe of the boot on which it is mounted, a receptacle mounted on a upper surface of the main body portion for retaining a heat source, the receptacle comprising an elongated body portion having respective side walls and end walls extending upwardly from the main body portion of the device, and including a cover hinged on the receptacle to retain a heat source therein and to permit access to the interior thereof to replace such heat source as needed, and the heat source provided for heating the inner core of the device and thereby warming the boot and the foot contained therein.

2. A warming device as claimed in claim 1 wherein an outer surface of the main body portion is covered with an insulating material to keep the heat generated by the heat source from dissipating to the outside air.

3. A warming device as claimed in claim 2 wherein an inner surface of the main body portion is covered with insulation to slow the radiation rate of heat to the boot below.

4. A warming device as claimed in claim 1 or 2 wherein the inner core is comprised of copper sheeting, an excellent heat-conductive material.

5. A warming device as claimed in claim 1 or 2 wherein a plurality of openings are provided in the inner core to control the flow of heat therefrom and a plurality of openings are provided in the receptacale to provide ventilation therethrough.

6. A warming device as claimed in claim 1 or 2 including a strap to secure the device to the boot.

* * * * *